US007610823B2

(12) United States Patent
Ponka

(10) Patent No.: US 7,610,823 B2
(45) Date of Patent: Nov. 3, 2009

(54) PERPETUAL BIDIRECTIONAL RATCHET

(75) Inventor: Philip Ponka, Thunder Bay (CA)

(73) Assignee: Metso Paper, Inc., Helsinki (FI)

( * ) Notice: Subject to any disclaimer, the term of this patent is extended or adjusted under 35 U.S.C. 154(b) by 924 days.

(21) Appl. No.: 11/325,855

(22) Filed: Jan. 5, 2006

(65) Prior Publication Data

US 2007/0152092 A1 Jul. 5, 2007

(51) Int. Cl.
*F16H 27/02* (2006.01)

(52) U.S. Cl. ..... 74/143; 74/141.5; 74/128

(58) Field of Classification Search ..... 74/88, 74/96, 99 R, 102, 104, 106, 126, 128, 141.5, 74/143

See application file for complete search history.

(56) References Cited

U.S. PATENT DOCUMENTS

| | | | | |
|---|---|---|---|---|
| 315,883 | A | 4/1885 | Arnold | |
| 474,068 | A | 5/1892 | Shaw | |
| 571,679 | A | 11/1896 | McCullough et al. | |
| 691,697 | A | 1/1902 | Baker | |
| 1,341,305 | A | 5/1920 | Engel | |
| 1,766,364 | A | 6/1930 | Waller | |
| 1,832,160 | A | 11/1931 | Vischer, Jr. | |
| 2,457,381 | A | 12/1948 | Kilholm | |
| 2,732,101 | A * | 1/1956 | Sohn | 222/320 |
| 3,029,653 | A | 4/1962 | Nilsson | |
| 3,291,681 | A | 12/1966 | Wolf | |
| 4,605,472 | A | 8/1986 | Nakamura | |
| 4,679,453 | A * | 7/1987 | Morita et al. | 74/128 |
| 5,638,997 | A * | 6/1997 | Hawkins et al. | 222/391 |
| 7,536,871 | B1 * | 5/2009 | Sciortino | 62/320 |

* cited by examiner

*Primary Examiner*—David M Fenstermacher
(74) *Attorney, Agent, or Firm*—Stiennon & Stiennon

(57) ABSTRACT

A two directional traversing mechanism uses a ratchet bar moved by an actuator to oscillate. Notches in the ratchet bar engage a pawl pivotally mounted to a piece of equipment so that the pawl and equipment move in the first direction. When the direction of the ratchet bar is reversed either the pawl is moved forward to an adjacent notch, or the pawl swings due to a biasing force such that when the ratchet bar again reverses direction, the ratchet bar causes the bar to pivot the pawl in a direction opposite the first direction. When the ratchet bar again operates in the reverse direction the pawl now engages with a notch of the ratchet bar and moves the equipment in the reverse direction.

8 Claims, 4 Drawing Sheets

PERPETUAL BIDIRECTIONAL RATCHET

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices which cause linear motion of a machine component in general, and to devices employing a ratchet mechanism in particular.

Papermaking is usually performed on a papermaking machine which manufactures a paper web many meters wide, typically 5-10 meters wide in a cross machine direction which is perpendicular to the direction defined by the motion of the paper web as it is being formed. Within the papermaking machine, for most processes, every effort is made to treat the entire width of the paper web uniformly to insure cross machine direction uniformity in the paper web being formed. However for some processes within the papermaking machine it is not necessary or cost-effective to perform a particular operation simultaneously on the entire cross machine direction width of the web. For example, when properties of the web are monitored in the cross machine direction it is often sufficient to have the monitoring instrument be moved from one edge of the paper web to the other, traversing back and forth across the web in a systematic manner. In addition, instruments which measure web caliper, web density, web moisture, web curl, etc. can be periodically scanned in the cross machine direction over the paper web. Cleaning operations which need not be continuous but which are necessary to maintain the functionality of a roll, an air knife, a fabric, a felt or a wire, can be performed with a cleaning unit which is moved back and forth in the cross machine direction.

Because of the wide width of the papermaking machine, of up to around 10 m, the test instrument or cleaning unit will typically be positioned on machine ways, linear bearings, or wheels mounted to a cross machine direction bridge which provides the required stiffness and resistance to vibration necessary for accurate positioning of a scanning instrument or cleaning device. The remaining necessity is some means of driving the test instrument or cleaning unit back and forth in a cross machine direction. Known approaches are the use of a machine screw, a rack and pinon gear arrangement, or a belt or cable drive, however these approaches require expensive components, or suffer from a lack of reliability, require significant maintenance or utilize an excessive amount of space. What is needed is a mechanically simple, low-cost, compact, and reliable means for traversing a piece of equipment back and forth in the cross machine direction over the entire width of a paper web in a papermaking machine.

SUMMARY OF THE INVENTION

The traversing mechanism of this invention employs a short stroke, double acting pneumatic or hydraulic actuator connected to oscillate a ratchet bar with a forward stroke and reverse stroke provided by the double action of the pneumatic or hydraulic actuator. A series of spaced apart notches or teeth are cut into the ratchet bar forming outwardly opening notches and outwardly protruding teeth between the notches. The stroke of the double acting pneumatic or hydraulic actuator is slightly greater than the distance between the notch center lines. Thus with each stroke of the double acting actuator the ratchet bar is moved forward or back slightly more than the distance between notch centers. A piece of equipment movable in the cross machine direction on a linear bearing has a pivotally mounted pawl which is biased by gravity or a spring to engage the spaced apart notches of the ratchet bar. When the pawl is engaged with a notch of the ratchet bar it moves with the ratchet bar, causing the piece of equipment to move along the linear bearing to which the piece of equipment is mounted. When the direction of the ratchet bar is reversed, one of two actions results. First, if a protruding portion of the bar follows the notch in a direction defined by the reversed movement of the ratchet bar, then the pawl is biased by the protruding portion further against the spring or gravity and the pawl slides over the ratchet bar until encountering another notch in the ratchet bar. Secondly, if no portion of the bar engages the pawl during the ratchet bar's motion in the reverse direction, the pawl swings until aligned with the force of gravity or by the spring. When the ratchet bar again reverses direction, the forward motion of the ratchet bar causes the bar to again engage the pawl but not move the attached equipment. Instead, the pawl is biased by the bar against the spring or gravity so that the pawl pivots in a direction opposite to that when the pawl and equipment are moving in the forward direction. When the ratchet bar again operates in the reverse direction the pawl now engages within the notch of the ratchet bar and the equipment moves in the reverse direction.

The reversing action requires that at least one motion of the pawl and the equipment attached thereto moves less than the normal step either before the reversal or after the reversal of direction. The partial step allows the ratchet bar to disengage from the pawl and then reengage the pawl so the pawl acts in a reverse direction.

It is a feature of the present invention to provide a self-reversing cross machine direction traversing mechanism of simplicity and low-cost.

It is a further feature of the present invention to provide a reversible cross machine direction traversing mechanism in a papermaking machine of lower-cost.

It is another feature of the present invention to provide a reversible cross machine direction traversing mechanism in a papermaking machine for conveying a cleaner or an instrument, the mechanism serving to repeatedly traverse the cleaner or instrument from the back to the front, and from front to the back, of the papermaking machine.

Further objects, features and advantages of the invention will be apparent from the following detailed description when taken in conjunction with the accompanying drawings.

DESCRIPTION OF THE PREFERRED EMBODIMENTS

Figure 1:
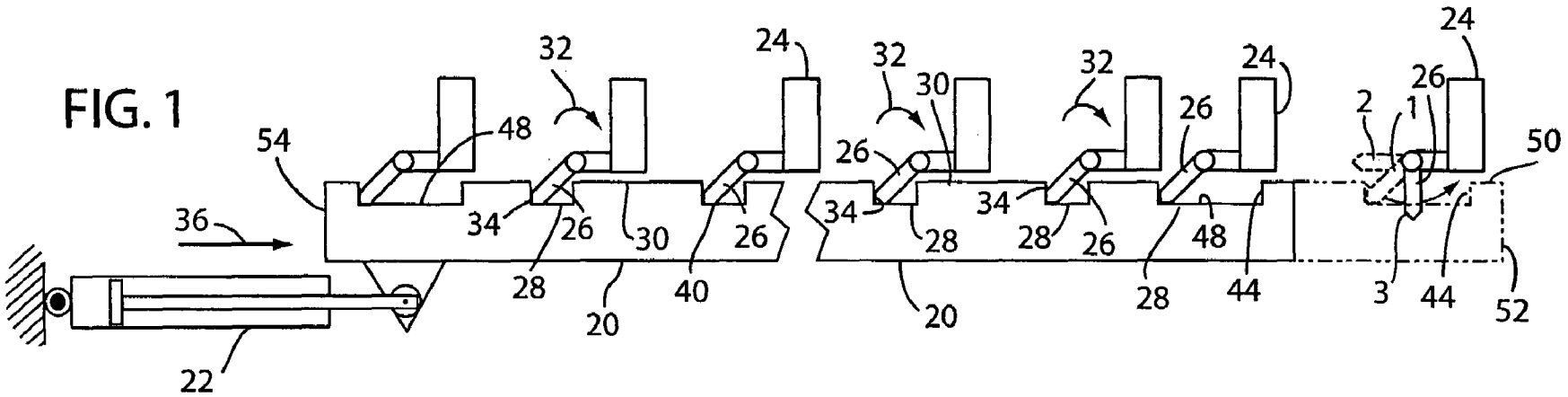
FIG. 1 is a side elevational schematic view of a ratchet mechanism of this invention showing linear motion in a first direction.

Referring more particularly to FIGS. 1-5 wherein like numbers refer to similar parts, FIG. 1 shows a ratchet bar 20 which is moved back and forth in an oscillating motion by a double acting pneumatic actuator 22. A piece of equipment 24 is mounted to a linear bearing (not shown) which extends in a cross machine direction in a papermaking machine. A pawl 26 is pivotally mounted to the piece of equipment 24. The pawl 26 engages with notches 28 or teeth 30 defined between the notches which are formed on the ratchet bar 20. As shown in FIG. 1, the piece of equipment 24 is progressively moved in a first direction i.e., to the right as indicated by arrows 32. The distance from the beginning or left-hand side 34 of one notch 28 to the beginning or left-hand side of an adjacent notch 40 is uniform and/or less than the stroke of the pneumatic actuator 22.

Thus, as shown in FIG. 1, when the ratchet bar 20 moves in a first direction, shown by arrow 36, the pawl 26 pushes the pawl and the equipment 24 to the right by the distance between left-hand sides of adjacent notches 28. When the pawl 26 is engaged with the beginning or left-hand side of a notch 28 it assumes a first position labeled 1 in FIG. 4. When the double acting pneumatic actuator 22 reverses direction the end or right-hand side 44 of the notch 28 engages the pawl 26 lifting it in to a second position labeled 2 in FIG. 4 until the adjacent notch 40 is positioned below the pawl and the pawl pivots downwardly into engagement with the left-hand side of the adjacent notch 40. By repeated action of the double acting pneumatic actuator 22, acting first to the right and then to the left, the pawl and the equipment to which the pawl is mounted moves in steps to the right.

Figure 2:
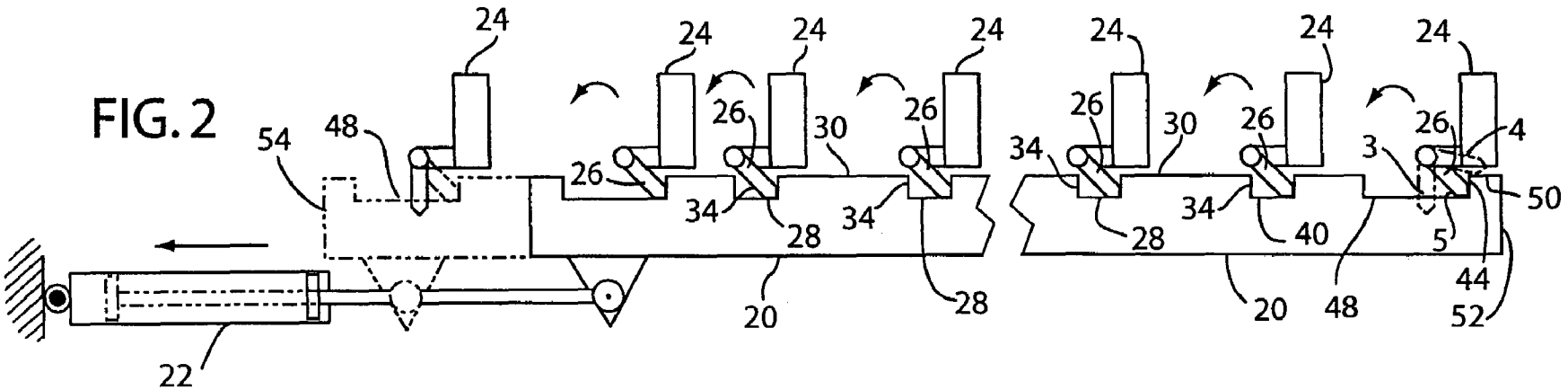
FIG. 2 is a side elevational schematic view of the racket mechanism of FIG. 1 showing linear motion in a second direction opposite to the first direction.

The reversal of the motion of the pawl 26 and the piece of equipment 24 to which the pawl is engaged is explained by reference to FIG. 4 and the right hand ends of FIGS. 1 and 2. Referring to position 1 of FIG. 4, the arrangement of the pawl 26 is such that although the pawl is pivotally mounted to the equipment 24 it is not free to pivot because the equipment 24 and the ratchet bar 20 are constrained by linear bearings such that they are movable only in a horizontal, and not in the vertical plane. Position 1 of the pawl 26 when moved as indicated by arrow 42 creates an upward thrust on the equipment 24 and a downward thrust on the ratchet bar 20 which are resisted by the linear bearing on which the equipment 24 is mounted, and on the linear bearing on which the ratchet bar 20 is mounted. The forward thrust of the pneumatic actuator 22 and the ratchet bar is transmitted through the pawl 26 to the equipment 24. The entire force supplied by the ratchet bar 20 aside from any friction losses is transmitted through the pawl to the equipment 24 because the vertical forces on the equipment 24 and the ratchet bar 20 are opposite sign so, neglecting friction, the linear forces on the ratchet bar are identical to the linear forces applied to the equipment 24 through the pawl 26. The end of the pawl which engages the notches 28, 48 is a pointed right angle as shown in FIGS. 1, 2, 3,and 4, which fits against the bottom and one side of the notches 28, 48.

In normal operation the position 1 is followed by lifting up of the pawl 26 by the interaction of the right-hand side 44 with the pawl, followed by the pawl engaging the left-hand side on the following or adjacent notch as described above. The orientation of the pawl 26 is reversed between FIG. 1 and FIG. 2 and the reversing of the pawl orientation is accomplished as shown in FIG. 4. Referring to position 3 of FIG. 4, as a first end 52 of the ratchet bar 20 is pulled past the pawl 26, the pawl is released and allowed to assume a neutral position under the force of gravity. From this neutral position, as shown in position 3, the forward motion of the ratchet bar 20 causes the pawl to swing to the right, position 4, and engage the right hand side 44 a notch 48 so that, as shown in position 5 of FIG. 4, the pawl moves the equipment 24 to the left as the ratchet bar oscillates to the left.

In order for the reversal of the pawl to occur it is necessary that the oscillation of the ratchet bar 20 to the left frees the pawl 26 to return to the neutral position 3 and that the oscillation of the ratchet bar to the right, as shown in position 4, moves the notch 48 underneath the pawl 26 until the pawl drops into the notch 48 as shown in position 5. For the same oscillatory motion on the ratchet bar 20 which moves the equipment 24 to cause a reversal of the pawl 26, it is necessary that the motion of the pawl and the equipment be less in the final step before the pawl reversal. Referring to FIGS. 1 and 2, a notch 48 is longitudinally larger than normal such that the left-hand side of the notch 48 is spaced considerably less than the distance between notches 28. Thus the pawl 26 and the equipment 24 are moved to the right only a fraction of the total stroke of the pneumatic actuator 22. This partial stroke allows the last upstanding portion 50 at the right end 52 of the ratchet bar 20 to be drawn past the pawl 26 as shown in position 2 of FIG. 4 by the normal leftward stroke of the actuator 22 and the ratchet bar 20, and to pick up the pawl with the right hand side of the notch 48 the next time the ratchet bar 20 moves to the left as shown in position 5 in FIG. 4.

Figure 4:
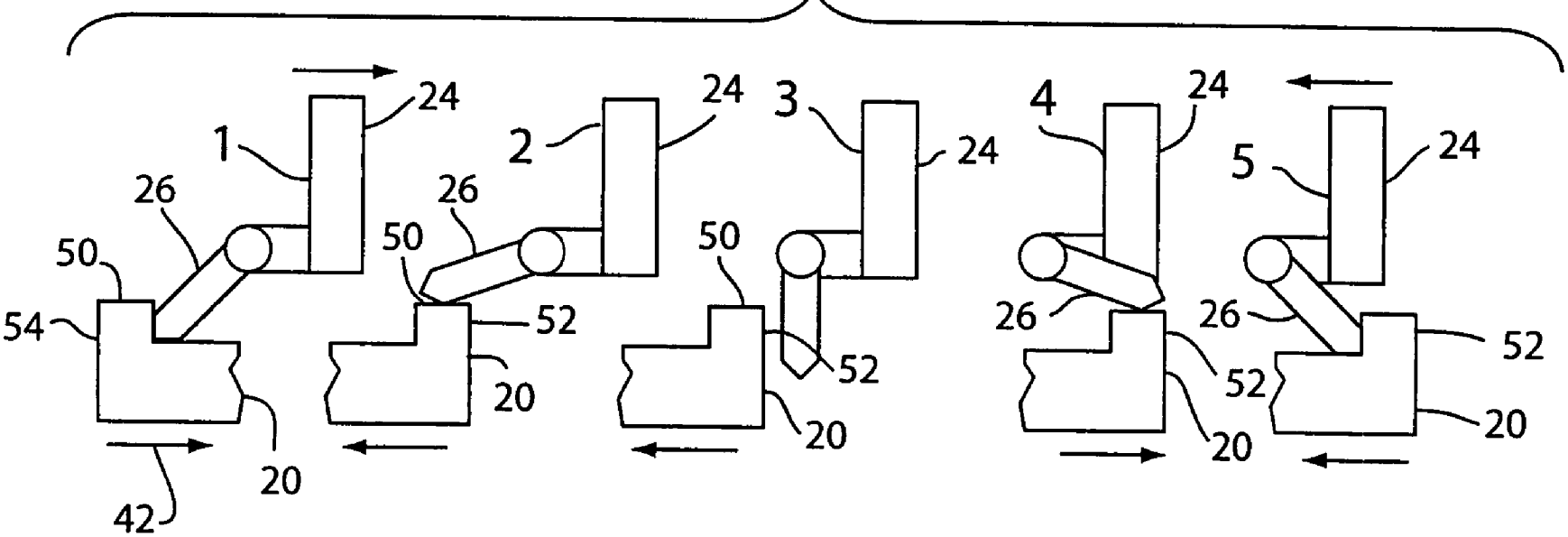
FIG. 4 is side elevational schematic view showing the motion of a pawl on the ratchet mechanism of FIG. 1.

The reversing of the motion of the equipment 24 on the left end 54 of the ratchet bar 20 is substantially identical to the series of steps shown in FIG. 4 except the steps 1-5 are performed as in a mirror image, and the left end 54 of the ratchet bar 20 is the mirror image of the right end 52 of the ratchet bar 20.

Figure 3:
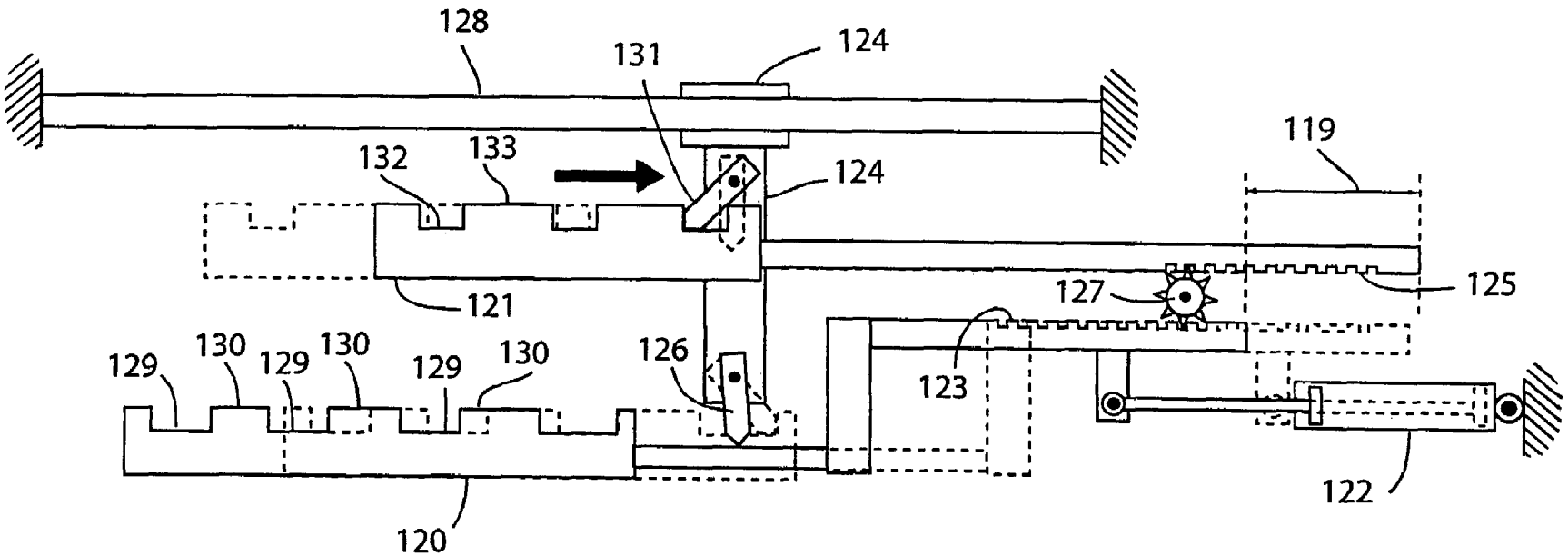
FIG. 3 is side elevational schematic view of an alternative embodiment of the ratchet mechanism of FIG. 1

An alternative embodiment ratchet mechanism which employs a first ratchet bar 120 and a second ratchet bar 121 is shown in FIG. 3. The first ratchet bar 120 is connected directly to a double acting pneumatic actuator 122 having a stroke length 119. The second ratchet bar 121 is geared to the first ratchet bar 120 by a double rack and pinion arrangement consisting of the first rack 123 on the first ratchet bar 120, and a second rack 125 mounted to the second ratchet bar 121, with a pinion gear 127 mounted therebetween. The pinion gear mounted for rotation, but not for linear motion. The first rack 123 changes the linear motion supplied by the pneumatic actuator 122 into rotating motion of the pinion gear 127. The second rack 125 changes the rotation of the pinion gear 127 back into linear motion which is 180° out of phase with the linear motion of the pneumatic actuator 122 and the first ratchet bar 120. A piece of equipment or equipment carriage 124 is mounted for linear motion to a guide bar 128. A first pawl 126 is pivotally mounted to the carriage 124 and interacts with the first ratchet bar 120, and the notches 129, and teeth 130 formed thereon. At the same time a second pawl 131 also pivotally mounted to the carriage 124 interacts with the second ratchet bar 121 and the notches 132, and teeth 133 formed a thereon. Each time the pneumatic actuator 122 extends or retracts the first ratchet bar 120 moves the stroke length 119 in the same direction as the actuator 122, and the second ratchet bar 121 moves the stroke length 119 in a direction opposite the actuator 122 and the first ratchet bar 120. This arrangement allows the equipment carriage 124 to move linearly each time the actuator 122 is extended or retracted, substantially increasing the speed and uniformity of the equipment carriage 124 and any equipment mounted thereto. The two ratchet bars 120, 121 and the corresponding pawls 126, 131 as shown in FIG. 3 perpetually reversed direction in concert causing the equipment carriage 24 to repeatedly traverse the guide bar 128 first in one direction and then the opposite direction.

Figure 5:
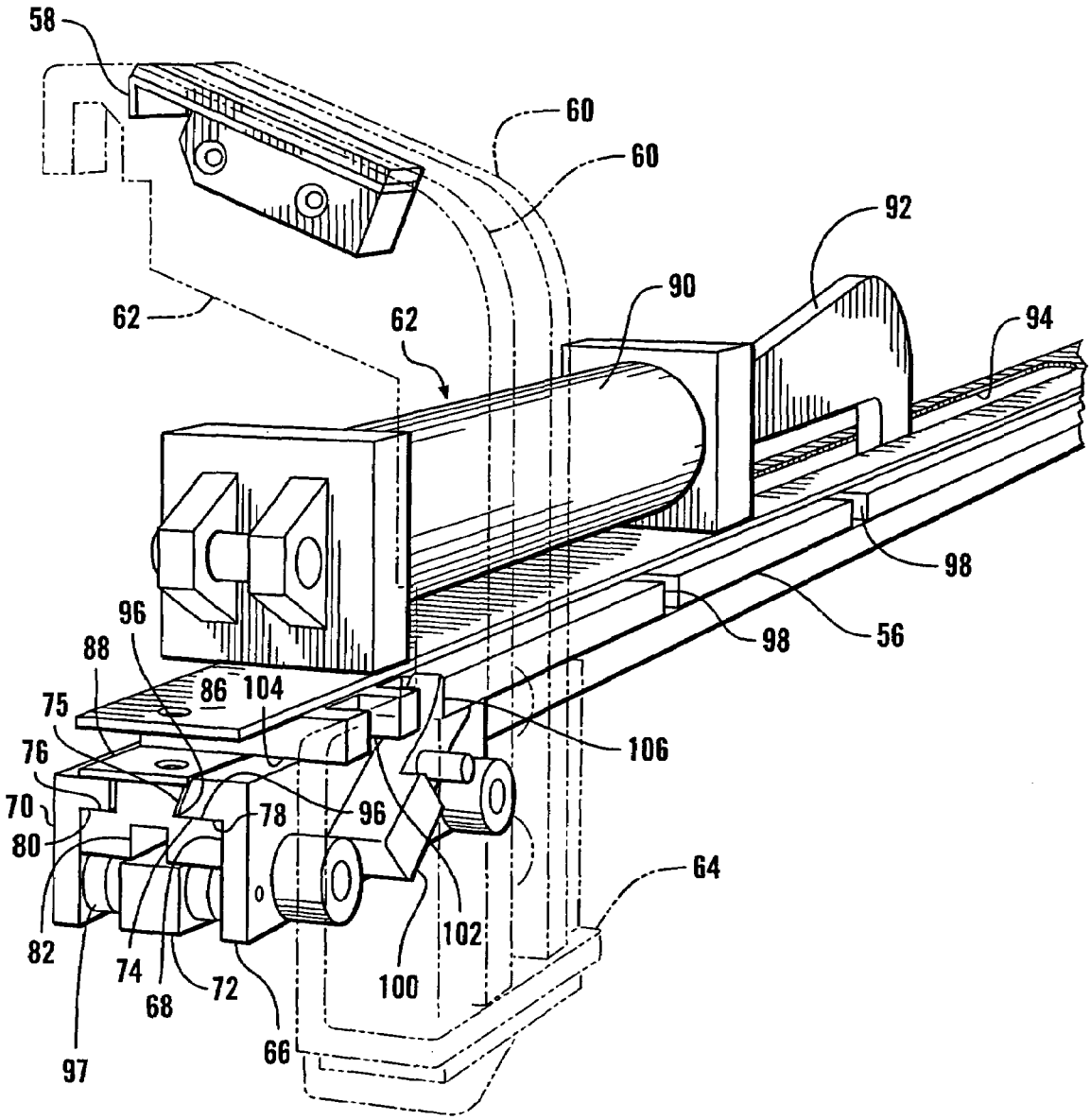
FIG. 5 is an isometric view of a further alternative embodiment of the ratchet mechanism of FIG. 1.

A further alternative embodiment ratchet bar 56 is shown in FIG. 5 for the particular application of moving a cleaner along the an air knife (not shown). In certain circumstances it is desirable to apply a spray of materials such as coating to a dryer cylinder within a papermaking machine. In order to prevent the coating from escaping from an application chamber over which a dryer cylinder rotates, a jet of air from an air knife contacts the dryer cylinder, and prevents the sprayed material migrating across the air knife. If coating accumulates on the air knife and partly or completely blocks the flow of air, the air knife is rendered nonfunctional. Thus periodically a cleaning a blade 58 is moved along the air knife to clean the air knife nozzle opening. The air knife cleaning blade is supported on cleaning legs 60 which clean the sides of the air knife and may use additional edges 62 to provide some removal of material from exterior surfaces forming part of the air knife structure. The cleaning legs 60 are cantilevered to a platform 64 which in turn is mounted to a carriage 66.

The carriage 66 has a first inverted L-shaped guide 68 and a second inverted L-shaped guide 70 which are held in fixed relation by a spacer block 72 which has a portion (not shown) which extends between the L-shaped guides. The short legs 74, 76 of the L-shaped guides 68, 70 ride on upwardly facing surfaces 78, 80 of an inverted T-shaped guide bar 82 which extends in the cross machine direction and is attached to the front and back sides of the papermaking machine. The pawl is not located symmetrical to the T-shaped guide bar 82. When the pawl is loaded, it imparts a torque on the carriage 66 about an axis that is approximately longitudinal to the T-shaped guide bar. The bearing surfaces 78, 96 are relatively larger than the bearing surface 80 to suit the offset location of the pawl. When the pawl is loaded, it causes vertically downward loading on the side of the carriage where the pawl is located adjacent the L-shaped guide 68. When the cantilevered cleaning legs 60 are loaded due to friction which acts in the cross-machine direction, the cantilevered cleaning legs 60 impart a torque upon the carriage 66. This torque is about an axis that is approximately perpendicular to the T-shaped guide bar and approximately parallel to the bearing surfaces 78 and 80. To reduce frictional loading that occurs between the T-shaped guide bar 82 and the carriage 66 due to the various loadings, four wheels 97, two of which are visible in FIG. 5, are mounted beneath the T-shaped guide bar 66. The wheels 97 are mounted between the first and second L-shaped guides 68, 70 and portions of the spacer block 72 as shown in FIG. 5.

The ratchet bar 56 is positioned between a lower bearing plate 88 and an upper bearing plate 86 fabricated of bearing bronze. The upper and lower bearing plates are spaced apart and mounted to the guide bar 82. A double acting pneumatic actuator 90 is mounted over the upper bearing plate, and is connected by an arm 92 to the ratchet bar 56 through a slot 94 in the upper bearing plate 88. Actuation of the pneumatic actuator 90 causes the ratchet bar 56 to oscillate back and forth while engaged between the upper and lower bearing plates. The ratchet bar 56 has a series of slots (not shown) through which guide pins (not shown) extend to connect the upper bearing plate to the lower bearing plate. The guide pins and the slots constrain the ratchet bar motion to a straight linear path that is parallel to the motion of the pneumatic actuator 90.

The ratchet bar 56 has evenly spaced notches 98 which are engaged by a counterweight pawl 100 mounted to the platform 64 and to the carriage 66. The spacing of the notches 98 is slightly less than the stroke of the pneumatic actuator 90. The pawl 100 extends upwardly to engage in the notches 98 and causes the carriage 66 to move progressively along the ratchet bar 56. The pawl 100 has an end in the shape of a right angle notch and it engages the side and lower surface of the ratchet bar 56. Reversal of the direction of the carriage 66 is accomplished in a way similar to that described above with respect to FIGS. 1-4. However, instead of having the notches closest to either end of the ratchet bar being longer than normal so that the equipment moves only one half step, a separate end notch 102 is closely spaced between the end 104 of the ratchet bar 56 and the last regularly spaced notch 106. After the ratchet bar end 104 is a drawn past the pawl 100 allowing the pawl to move to a vertical position and to be reversed by the next movement of the ratchet bar, the pawl 100 is engaged by the end-notch 102. The movement of the carriage 66 when the pawl is engaged with the end notch 102 is only sufficient to allow the pawl to engage with the last regularly spaced notch 106. Once the pawl is engaged with the regularly spaced notch the carriage moves a distance equal to the regular spacing between notches with each complete cycle of the pneumatic actuator 90.

It should be understood that instead of a partial rightward or leftward movement at the ends of the bar, the pneumatic actuator may be allowed or controlled to make only a partial stroke. For example, the equipment's rightward or leftward movement could be constrained by a stop or, motion of the equipment beyond a rightward or leftward position could be arranged to vent the pneumatic actuators to prevent further motion. It is also possible that all movements towards the bar ends are uniform but the first step away from the bar end is only partial as shown with respect to FIG. 5 wherein the first step away from the bar end results in moving the pawl to a closely spaced adjacent notch 106.

It should also be understood that were in two or more ratchet bars are used such as shown in FIG. 3 various mechanisms, such as a pivoting arm, or a free-floating piston with twice the desired movement of the ratchet bars connected between the ratchet bars, and other similar mechanical arrangements could be you.

It is understood that the invention is not limited to the particular construction and arrangement of parts herein illustrated and described, but embraces all such modified forms thereof as come within the scope of the following claims.

I claim:

1. A mechanism for causing linear motion, comprising:

a first ratchet bar, having a first end and a second end defining an oscillatory axis therebetween;

an oscillator, the first ratchet bar being mounted to the oscillator for linear oscillatory motion of a substantially fixed distance along the oscillatory axis but varying sign in a direction along the oscillatory axis, the first ratchet bar having a plurality of portions evenly spaced a first spacing which is less than the fixed distance, each of the plurality of portions defining a first pawl engaging structure and a second opposed pawl engaging structure, wherein the first pawl engaging structures are evenly spaced the first spacing along the first ratchet bar, and the second pawl engaging surfaces are also spaced the first spacing along the first ratchet bar;

a first additional portion of the first ratchet bar between the plurality of evenly spaced portions and the first end, wherein the first additional portion has a spacing from an adjacent one of said plurality of evenly spaced portions which is either less than the first spacing, or has at least one first or second pawl engaging structure which is spaced less than the first spacing from an adjacent first or second pawl engaging structure of one of the evenly spaced portions;

a second additional portion of the first ratchet bar between the plurality of evenly spaced portions and the second end, wherein the second additional portion has a spacing from an adjacent one of said plurality of evenly spaced portions which is either less than the first spacing, or has at least one first or second pawl engaging structure which is spaced less than the first spacing from an adjacent first or second pawl engaging structure of one of the evenly spaced portions;

a pawl pivotally mounted to a piece of equipment, the equipment mounted for linear motion in a direction along the first ratchet bar, the pawl having first portions arranged to engage the first pawl engaging surfaces for motion in a positive direction along the oscillatory axis of the first ratchet bar, and the pawl having second portions arranged to engage the second pawl engaging surfaces for motion in a direction opposite the positive direction;

wherein the first additional portion and the first ratchet bar first end are arranged to cooperate to reverse the pawl from a position which engages the first pawl engaging structures to a position which engages the second pawl engaging structures; and wherein the second additional portion and the first ratchet bar second end are arranged to cooperate to reverse the pawl from a position which engages the second pawl engaging structures to a position which engages the first pawl engaging structures.

2. The mechanism of claim 1 wherein the oscillator is a double acting pneumatic actuator.

3. The mechanism of claim 1 further comprising:

a second ratchet bar mechanically connected to the oscillator to move along the oscillatory axis in a direction opposite and 180° out of phase with the first ratchet bar;

a second pawl pivotally mounted to the piece of equipment, the second pawl having portions arranged to engage pawl engaging surfaces of the second ratchet bar for motion in the oscillatory direction, and the second pawl having portions arranged to engage the second pawl engaging surfaces for motion in an opposite direction along the oscillatory axis; and wherein portions of the second ratchet bar are arranged to cooperate to reverse the second pawl.

4. The mechanism of claim 1 wherein the first portions arranged to engage the first pawl engaging surfaces for motion in the oscillatory direction, and the pawl second portions arranged to engage the second pawl engaging surfaces for motion in a direction opposite the oscillatory direction, are substantially the same portions of the pawl.

5. A mechanism for causing linear motion of a piece of equipment or a carriage in a cross machine direction to traverse at least a width of a paper web in the cross machine direction in a papermaking machine, the mechanism comprising:

at least one ratchet bar having a first end and a second end defining an oscillatory axis therebetween, the at least one ratchet bar being connected to a means for oscillating, wherein the ratchet bar has a plurality of evenly spaced pawl engaging means, and a first pawl reversing means at the first end, and a second pawl reversing means at the second end; and a pawl pivotally mounted to the piece of equipment or carriage, the pawl being engageable with the evenly spaced pawl engaging means on the ratchet bar and arranged to cause linear motion of the piece of equipment in the cross machine direction so as to cause the piece of equipment to traverse back and forth across the width of the paper web and along the oscillatory axis.

6. The mechanism of claim 5 further comprising:

a second ratchet bar extending in the direction of the oscillatory axis in spaced parallel relation to the at least one ratchet bar, the second ratchet bar having a plurality of spaced pawl engaging means, and a first pawl reversing means at a first end and a second pawl reversing means at a second end, the second ratchet bar connected to the means for oscillating the ratchet bar so that the second ratchet bar oscillates on the oscillatory axis 180° out of phase with the one ratchet bar; and a second pawl pivotally mounted to the piece of equipment or carriage, the pawl engageable with the evenly spaced pawl engaging means on the second ratchet bar and arranged to cause linear motion of the piece of equipment in the cross machine direction so as to cause the piece of equipment or carriage to traverse in the same direction as the first pawl.

7. A method of causing linear motion of a piece of equipment mounted for motion along a linear bearing, comprising the steps of:

moving a ratchet bar in a first direction a selected distance, followed by moving the ratchet bar in a second direction opposite the first direction, by the selected distance, and continuously repeating in sequence the motion in the first direction, followed by the motion in the second direction to perform a continuous oscillatory motion of the ratchet bar;

engaging the piece of equipment with a pawl to the oscillating ratchet bar as the ratchet bar moves in the first direction a selected number of times;

following the movement of the piece of equipment in the first direction a selected number of times, using the oscillation in the second direction to disengage the pawl from the ratchet bar, followed by using the oscillation in the first direction to reengage the piece of equipment with the pawl to the oscillating ratchet bar so that as the ratchet bar moves in the second direction, the equipment moves in the second direction; and moving the piece of equipment a selected number of times in the second direction.

8. The method of claim 7 further comprising the step of mounting the piece of equipment in a paper handling machine on a cross machine direction extending mechanism along the linear bearing so that the piece of equipment continuously traverses back-and-forth at least a length defined by a paper web width.

* * * * *

UNITED STATES PATENT AND TRADEMARK OFFICE

CERTIFICATE OF CORRECTION

PATENT NO. : 7,610,823 B2
APPLICATION NO. : 11/325855
DATED : November 3, 2009
INVENTOR(S) : Philip Ponka It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 974 days.

Signed and Sealed this

Twelfth Day of October, 2010

David J. Kappos

David J. Kappos
*Director of the United States Patent and Trademark Office*